US011832729B2

(12) United States Patent
Harrison et al.

(10) Patent No.: US 11,832,729 B2
(45) Date of Patent: Dec. 5, 2023

(54) COVER FOR PROTECTING AGAINST INSECTS

(71) Applicant: Mozzie Style, LLC, Norman, OK (US)

(72) Inventors: Jamie Harrison, Piedmont, OK (US); Heather Boles, Norman, OK (US)

(73) Assignee: Mozzie Style, LLC, Norman, OK (US)

( * ) Notice: Subject to any disclaimer, the term of this patent is extended or adjusted under 35 U.S.C. 154(b) by 199 days.

(21) Appl. No.: 17/647,060

(22) Filed: Jan. 5, 2022

(65) Prior Publication Data

US 2022/0211187 A1 Jul. 7, 2022

Related U.S. Application Data

(60) Provisional application No. 63/134,063, filed on Jan. 5, 2021.

(51) Int. Cl.
*A47C 29/00* (2006.01)
*D04H 3/045* (2012.01)

(52) U.S. Cl.
CPC ..... *A47C 29/006* (2013.01); *D04H 3/045* (2013.01); *D10B 2101/20* (2013.01); *D10B 2331/04* (2013.01); *D10B 2507/02* (2013.01)

(58) Field of Classification Search
CPC ..... A47C 29/006
See application file for complete search history.

(56) References Cited

U.S. PATENT DOCUMENTS

| | | | | | |
|---|---|---|---|---|---|
| 823,469 | A * | 6/1906 | Hoenigsberger | A41D 3/00 | 2/69 |
| 3,862,876 | A * | 1/1975 | Graves | E04G 21/28 | 47/9 |
| 4,634,618 | A * | 1/1987 | Greer | A47G 9/062 | 428/126 |
| 4,932,077 | A * | 6/1990 | Dobbs | A61G 5/1054 | 2/69.5 |
| 4,961,981 | A * | 10/1990 | Keegan | B60J 11/00 | 428/72 |
| 6,634,040 | B2 * | 10/2003 | Le Gette | A47G 9/062 | 5/419 |
| 7,260,857 | B2 * | 8/2007 | Cazzini | A47G 9/0223 | 5/482 |
| 7,392,555 | B2 * | 7/2008 | Danaher | A47C 29/006 | 135/96 |
| 2006/0174410 | A1 * | 8/2006 | Mastandrea, Jr. | A01K 1/0353 | 5/482 |

* cited by examiner

*Primary Examiner* — Noah Chandler Hawk
(74) *Attorney, Agent, or Firm* — Dunlap Codding, P.C.

(57) ABSTRACT

A protective cover including a mesh sheet, a first pliable support member, and, in some embodiments, a second pliable support member. The mesh sheet has a first end, a second end, a top end, and a bottom end. The first pliable support member extends between the first end and the second end and is spaced a distance away from the top end. In embodiments having a second pliable support member, the second pliable support member extends between the first end and the second end and is spaced a distance away from the top end and spaced a distance away from the first pliable support member. Each of the first and second pliable supports members is movable between a straight configuration and a bent configuration. The mesh sheet forms and sustains a wearable shape when each of the first and second pliable support members is in the bent configuration.

14 Claims, 6 Drawing Sheets

COVER FOR PROTECTING AGAINST INSECTS

INCORPORATION BY REFERENCE

The present application claims priority to a provisional patent application identified by U.S. Ser. No. 63/134,063, filed Jan. 5, 2021, titled "Cover For Protecting Against Insects"; the entire contents of which are hereby incorporated herein by reference.

BACKGROUND

Chemicals and devices exist to repel insects, such as mosquitos. Chemical mosquito repellents are generally applied directly to the skin or a user's clothing. Many of these chemical substances are mixed with loti53ons or other protective adjuvants, such as sunscreen. After repeated use, many chemical substances can result in unintended poisoning. Such chemical repellents often have a strong odor and leave a sticky residue on the user's skin or clothing that may be uncomfortable and/or difficult to remove. Moreover, these chemical repellents typically must be frequently reapplied, which adds to the cost of use as well as subjecting the user to an increased level of potential poisonous dosing.

Garments and other products also exist that are treated with insect repellents or insecticides. Some of these substances are also poisonous and are only effective until the active repellent/insecticide is depleted—which may occur after the garment has been washed multiple times. These products may also harmfully affect beneficial pollinating insects.

Other protective garments that do not incorporate insecticides have also been developed. These garments are typically bulky, unattractive and not desirable for extended wear. These protective garments tend to cling to the wearer's skin resulting in an uncomfortable garment that is quickly discarded thereby presenting the user once again to the noxious and potentially disease-carrying insects.

Mosquito nets, which are generally placed on fixed apparatuses, such as a bed or a window screen, are also known and used. These types of products are stationary and typically cannot be used outside of a single fixed location.

Therefore, a need exists for a portable, washable cover that protects a user from insect bites without the use of harmful chemicals—while allowing the user to wear his or her everyday clothing, which can be seen underneath the protective cover. Such a protective cover must also be comfortable to wear and not interfere with the user's internal bodily mechanisms for temperature regulation. It is to such a device that the inventive concepts disclosed herein are directed.

DETAILED DESCRIPTION OF EXEMPLARY EMBODIMENTS

Figure 1:
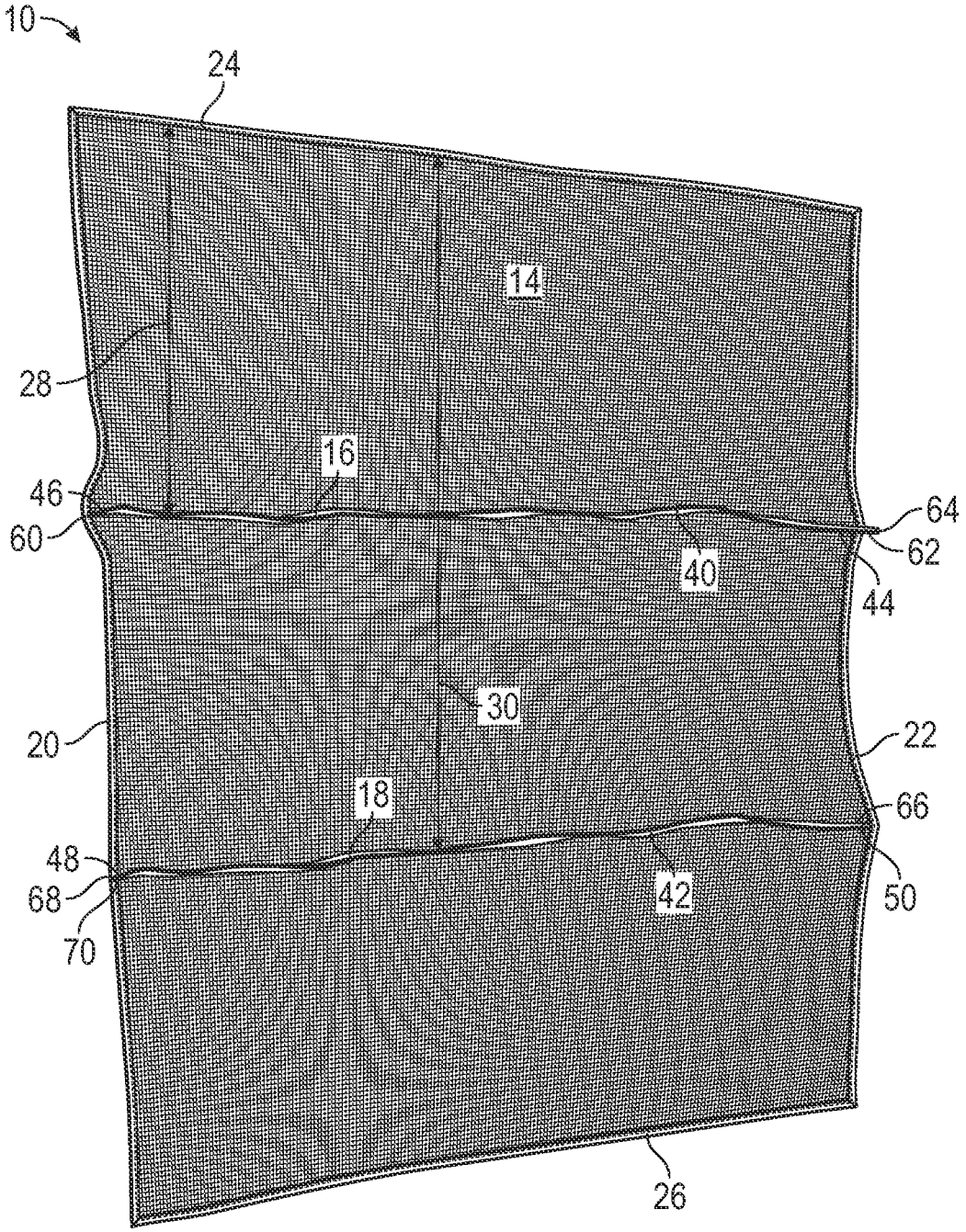
FIG. 1 is a front perspective view of a protective cover according to the inventive concepts disclosed herein

In the following detailed description of embodiments of the inventive concepts, numerous specific details are set forth in order to provide a more thorough understanding of the inventive concepts. However, it will be apparent to one of ordinary skill in the art that the inventive concepts disclosed and claimed herein may be practiced without these specific details. In other instances, well-known features have not been described in detail to avoid unnecessarily complicating the instant disclosure.

As used herein, the terms "comprises," "comprising," "includes," "including," "has," "having" or any other variation thereof, are intended to cover a non-exclusive inclusion. For example, a process, method, article, or apparatus that comprises a list of elements or steps is not necessarily limited to only those elements or steps and may include other elements, steps, or features not expressly listed or inherently present therein.

Unless expressly stated to the contrary, "or" refers to an inclusive "or" and not to an exclusive "or." For example, a condition A or B is satisfied by anyone of the following: A is true (or present) and B is false (or not present), A is false (or not present) and B is true (or present), and both A and B is true (or present).

In addition, use of the "a" or "an" are employed to describe elements and components of the embodiments herein. This is done merely for grammatical convenience and to give a general sense of the inventive concepts. This description should be read to include one or at least one and the singular also includes the plural unless it is obvious that it is meant otherwise.

Throughout this disclosure and the claims, the terms "about," "approximately," and "substantially" are intended to signify that the item being qualified is not limited to the exact value specified, but includes slight variations or deviations therefrom, caused by measuring error, manufacturing tolerances, stress exerted on various parts, wear and tear, or combinations thereof, for example.

The use of the term "at least one" will be understood to include one as well as any quantity more than one, including but not limited to each of, 2, 3, 4, 5, 10, 15, 20, 30, 40, 50, 100, and all positive integers there between. The term "at least one" may extend up to 100 or 1000 or more, depending on the term to which it is attached; in addition, the quantities of 100/1000 are not to be considered limiting, as higher limits may also produce satisfactory results. Singular terms shall include pluralities and plural terms shall include the singular unless indicated otherwise.

The term "or combinations thereof" as used herein refers to all permutations and/or combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment, although the inventive concepts disclosed herein are intended to encompass all combinations and permutations including one or more features of the embodiments described herein. As such, it should be readily apparent to one skilled in the art, given the present disclosure, to use or substitute features from one or more embodiments into the structures or methods of making and using other embodiments.

Referring now to FIGS. 1-7, a protective cover 10 for protecting against insects and insect bites is illustrated. The protective cover 10 may be worn by a wearer, such as a wearer 12 (shown in FIGS. 5 and 6) to guard and protect against undesirable insects, such as mosquitos and no-see-ums, while the wearer 12 is enjoying the outdoors or other environments where such noxious insects may be found. As explained further below, the protective cover 10 is generally constructed from a lightweight material and can be worn by the wearer 12 in a way that maintains a comfortable gap of air between the protective cover 10 and the skin of the wearer 12.

The cover 10 includes a mesh sheet 14, a first pliable support member 16, and a second pliable support member 18. The mesh sheet 14 includes a first end 20, a second end 22, a top end 24, and a bottom end 26—all of which define an outer periphery of the mesh sheet 14. Although the mesh sheet 14 is shown in a generally rectangular configuration in this embodiment, the outer periphery of the mesh sheet 14 may be of any geometric or fanciful shape. The first pliable support member 16 extends between the first end 20 and the second end 22 of the mesh sheet 14 and is spaced a first distance 28 away from the top end 24 of the mesh sheet 14. The second pliable support member 18 extends between the first end 20 and the second end 22 of the mesh sheet 14 and is spaced a second distance 30 away from the top end 24 of the mesh sheet 14. The second pliable support member 18 is also spaced a distance away from the first pliable support member 16. Each of the first pliable support member 16 and the second pliable support member 18 is reversibly movable between a flat configuration (shown in FIG. 1) and a bent configuration (shown in FIGS. 5 and 6). The mesh sheet 14 forms and sustains a wearable shape, such as a wearable shape 28, when the first pliable member 16 and the second pliable member 18 are in the bent configuration.

The protective cover 10 may be formed in variety of shapes and sizes (as initially mentioned above) including, but not limited to, rectangular, square, circle, and oval shapes. By way of example only, in the embodiment shown in FIG. 1, the protective cover 10 has the shape of a rectangle. The first end 20 and the second end 22 of the mesh sheet 14 may also have a variety of lengths that may be variable and not always identical to one another. For example, the first end 20 and the second end 22 may be, but are not limited to being, between about 50.0 to about 80.0 inches long. In one embodiment, each of the first end 20 and the second 22 is 60.0 inches long. Likewise, the top end 24 and the bottom end 26 of the mesh sheet 14 may also have a variety of lengths that may be variable and not always identical to one another. For example, the top end 24 and the bottom end 26 may be, but are not limited to being, between about 40.0 and about 70.0 inches long. In one embodiment, each of the top end 24 and the bottom end 26 is 50.0 inches long. It should be understood that the size and shape of the protective cover 10 may vary, and the shape of the protective cover 10 should not be construed as being limited to any particular shape set forth in the present disclosure. For example, the shape of the protective cover 10 may vary based on whether the cover 10 is intended to be used as a barrier for the arms, legs, entire body, or as a protective covering over any specific item.

The mesh sheet 14 may be formed of a variety of materials known in the art that allow air passage while simultaneously preventing insect biting and passage therethrough. The mesh sheet 14 should allow the user to form and maintain a desired shape when the first and second pliable support members 16, 18, respectively, are in the bent configuration. For example, but not by way of limitation, the mesh sheet 14 may be formed of a knit material of fine gauge netting polyester with a tricot weave. In one embodiment, the mesh sheet 14 is formed of 100% polyester. The mesh sheet 14 may be formed preferably of a lightweight, semi-sheer material and may weigh, but is not limited to weighing, between about 0.7 and about 0.9 ounces per square yard (osy). In one embodiment, the mesh sheet 14 weighs about 0.8 osy. The mesh sheet 14 may have, but is not limited to having, a mesh count between about 375 and about 450. In one embodiment, the mesh sheet 14 has a mesh count of about 400. The mesh sheet 14 may have a denier count between about 250 and about 350. In one embodiment, the mesh sheet 14 has a denier count of about 400.

The mesh sheet 14 may be formed, but is not limited to being formed, by a first machine-knitted thicker outer thread followed by a second thinner thread sewn in between the thicker outer threads. This weave may maximize strength of the mesh sheet 14 while allowing for air passage. The mesh sheet 14 may stretch in any direction. Also, in one embodiment, the mesh sheet 14 may not substantially allow for stretch in any direction. The mesh sheet 14 may also include a coating, which may assist in maintaining the structure of the mesh sheet 14 after multiples uses and/or multiple washes. In one embodiment, the mesh sheet 14 is colored white. The white color may increase the likelihood of repelling insects as compared to a darker color. For example, darker colors may have an unwanted side effect of trapping carbon dioxide released from a wearers body, which may further attract insects. Additionally, the mesh sheet 14 may be formed of a single material or the mesh sheet 14 may, in alternative embodiments, be formed of a laminate of two or more materials. In such an embodiment of the mesh sheet 14, the laminate may be the entirety of the mesh sheet 14, or in another embodiment, the laminate may comprise a portion of the mesh sheet 14.

Figure 5:
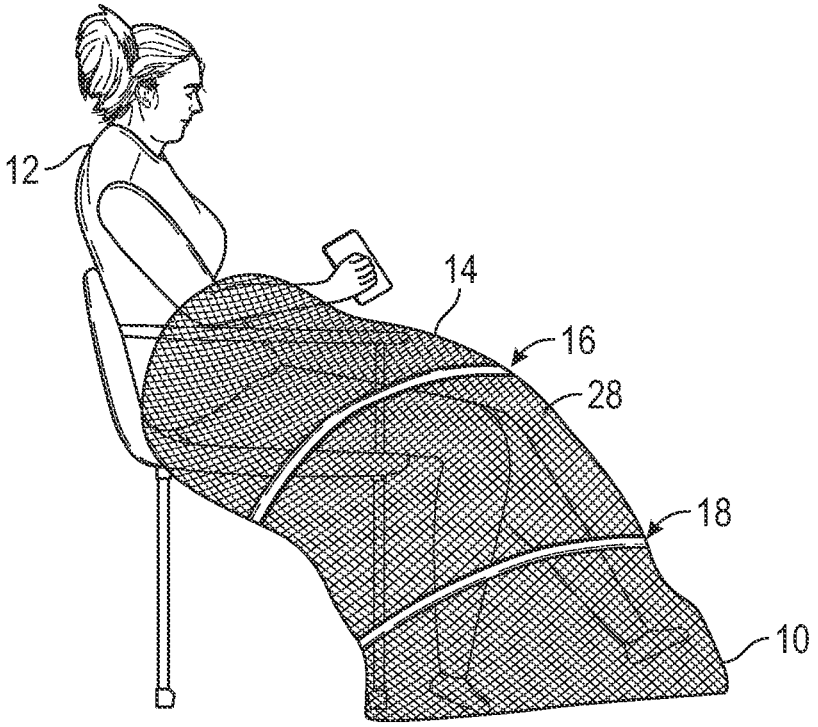
FIG. 5 is a diagrammatic view illustrating use of the protective cover of FIG. 1.
Figure 6:
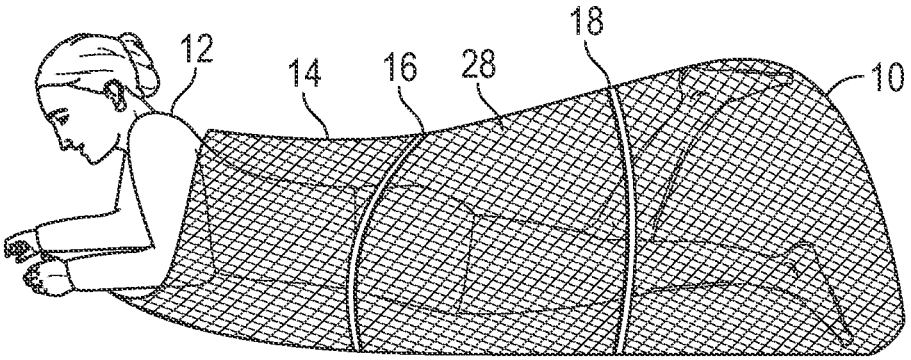
FIG. 6 is a diagrammatic view illustrating use of the protective cover of FIG. 1.

As shown in FIGS. 5 and 6, the first and second pliable support members 16 and 18 assist the wearer 12 in forming and arranging the protective cover 10 to maintain a shape so that the mesh sheet 14 does not substantially contact the skin of the wearer 12—thereby creating a comfortable bubble or microclimate underneath the mesh sheet 14 and around the wearer 12. The first and second pliable support members 16, 18, respectively, may be formed of a variety of pliable materials known in the art including, but not limited to, various types of plastics, metal, silicone, or combinations thereof. In one embodiment, the first and second pliable support members 16, 18, respectively, are formed of copper wire. In this embodiment, the copper wire may have a size of about 16 to about 20 AWG. In one embodiment, the first and second pliable support members 16 and 18 are formed of solid copper having a size of about 18 AWG. The size of the first pliable support member 16 may be different from the size of the second pliable support member 18. In the embodiment in which the pliable support members 16 and 18 are formed of copper wire, the copper wire of the first and second pliable support members 16, 18, respectively, may be coated with an outer layer. The outer lay may be formed, but it is not limited to being formed, of a polyamide including, but not limited to, nylon. One having ordinary skill in the art would appreciate that a variety of flexible, lightweight outer layers may be used to coat the copper wire. Such copper wire as described above may include wires as defined by the National Electrical Code (NEC) as fixture wires. Such wires have a softer temper and sustain their form when bent. It should be appreciated that the protective cover 10 may be provided with a third, fourth, or any number of pliable supports without deviating outside of the scope of the presently disclosed inventive concepts.

In another embodiment, the protective cover 10 does not include a first and second support member 16 and 18, but the mesh sheet 14 may still form and sustain a wearable shape around the wearer 12. In this embodiment, the mesh sheet 14 may be formed of a shape-memory polymer, nitinol threads, a hydrogel, biocompatible materials, Keratin based memory fabric (including fabric introduced with hydrogen peroxide and monosodium solutions), or any other materials suitable for forming and sustaining a desired shape. The mesh sheet 14 may be formed of any of these enumerated materials or may comprise of two or more such shape-memory materials.

The protective cover 10 may further include a first sleeve 40 and a second sleeve 42. The first sleeve 40 slidably receives the first pliable support member 16, and the second sleeve 42 slidably receives the second pliable support member 18. The first sleeve 40 includes a first open end 44 and a first closed end 46. The second sleeve 42 includes a second open end 48 and a second closed end 50. The first pliable support member 16 may be inserted into the first open end 44 and slid through the first sleeve 40 towards the first closed end 46. The second pliable support member 18 may be inserted into the second open end 48 and slid through the second sleeve 42 towards the second closed end 50. In the embodiment where the protective cover 10 includes a first and second sleeve 40, 42, respectively, the pliable support members 16, 18, respectively, may easily be removed from the mesh sheet 14 so that the mesh sheet 14 may be easily washed. The first and second sleeves 40, 42, respectively, may be formed of variety of suitable outdoor materials known in the art including, but not limited to, ripstop fabrics. Alternatively, the first and second sleeves 40, 42, respectively, may be formed of the same material as the mesh sheet 14. Any of the materials disclosed for use with the mesh sheet 14 may also be used, in whole or in part, with the first and second sleeves 40, 42, respectively.

Figure 2:
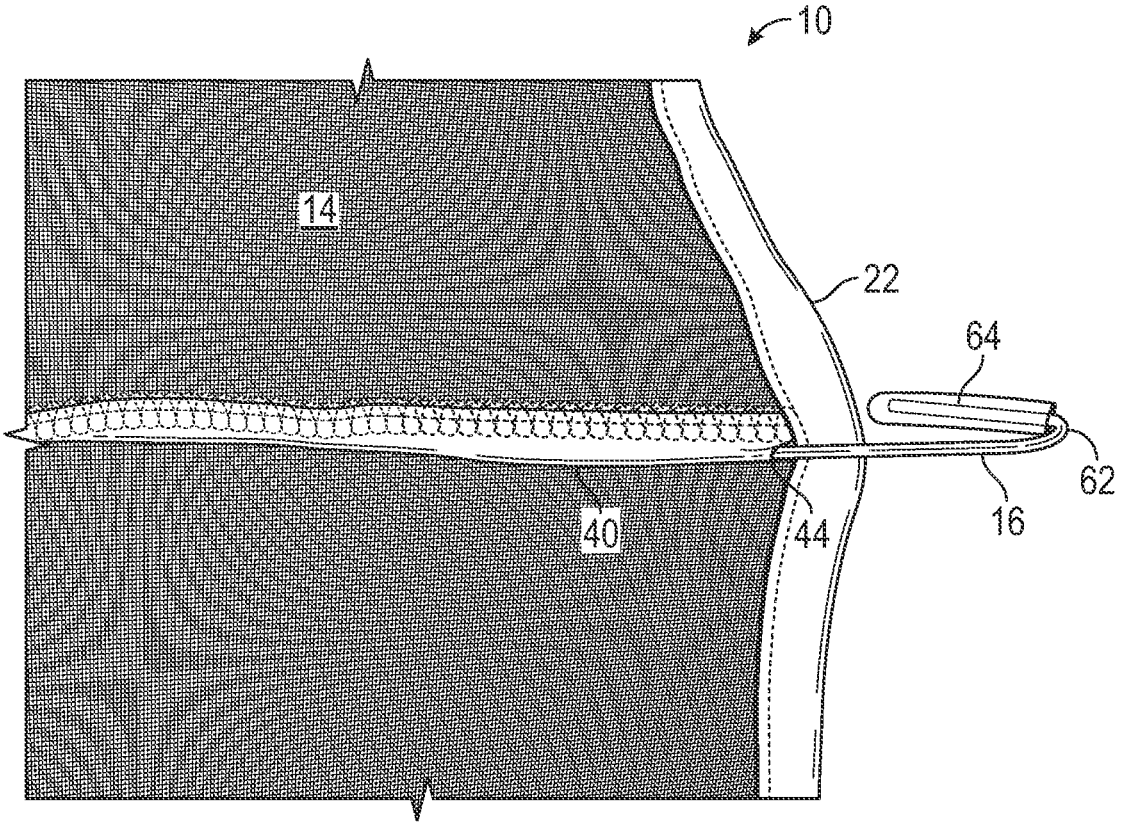
FIG. 2 is an enlarged perspective view of a portion of a support member of the protective cover of FIG. 1.
Figure 3:
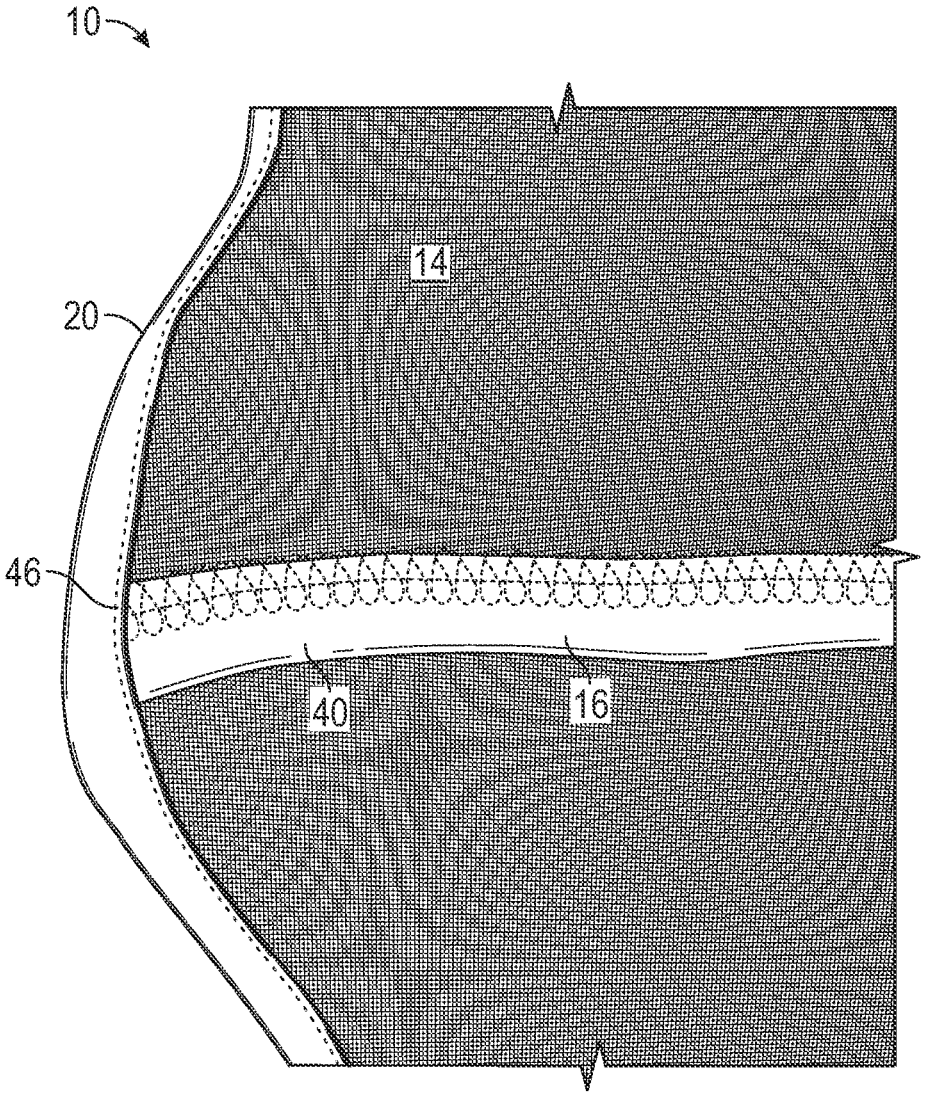
FIG. 3 is an enlarged perspective view of a portion of a sleeve of the protective cover of FIG. 1.

The first pliable support member 16 includes a distal end 60 and a proximal end 62. A first cap 64 may be disposed on the proximal end 62 of the first pliable support member 16. Similarly, the second pliable support 18 includes a distal end 66 and a proximal end 68. A second cap 70 may be disposed on the proximal end 68 of the second support member 18. As best shown in FIG. 2, the proximal end 62 of the first pliable support member 16 may protrude from the first sleeve 40 and bend back towards the mesh sheet 14 with the first cap 64 disposed on the proximal end 62 of the first pliable support member 16 in a way that removably secures the first pliable support member 16 in the first sleeve 40. It should be appreciated that the proximal end 68 of the second pliable support member 18 may be similarly constructed and oriented to that of the first pliable support member 16. It should also be appreciated that the first and second support members 16, 18, respectively, may be removably secured in the first and second sleeves 40 and 42 by a variety of mechanisms including, but not limited to, Velcro® hook and loop, magnets, a pocket fold, or some combination thereof. Additionally, the first and second pliable support members 16, 18 respectively, may each have caps thereon or one or more ends may be used without a cap thereon.

Figure 4:
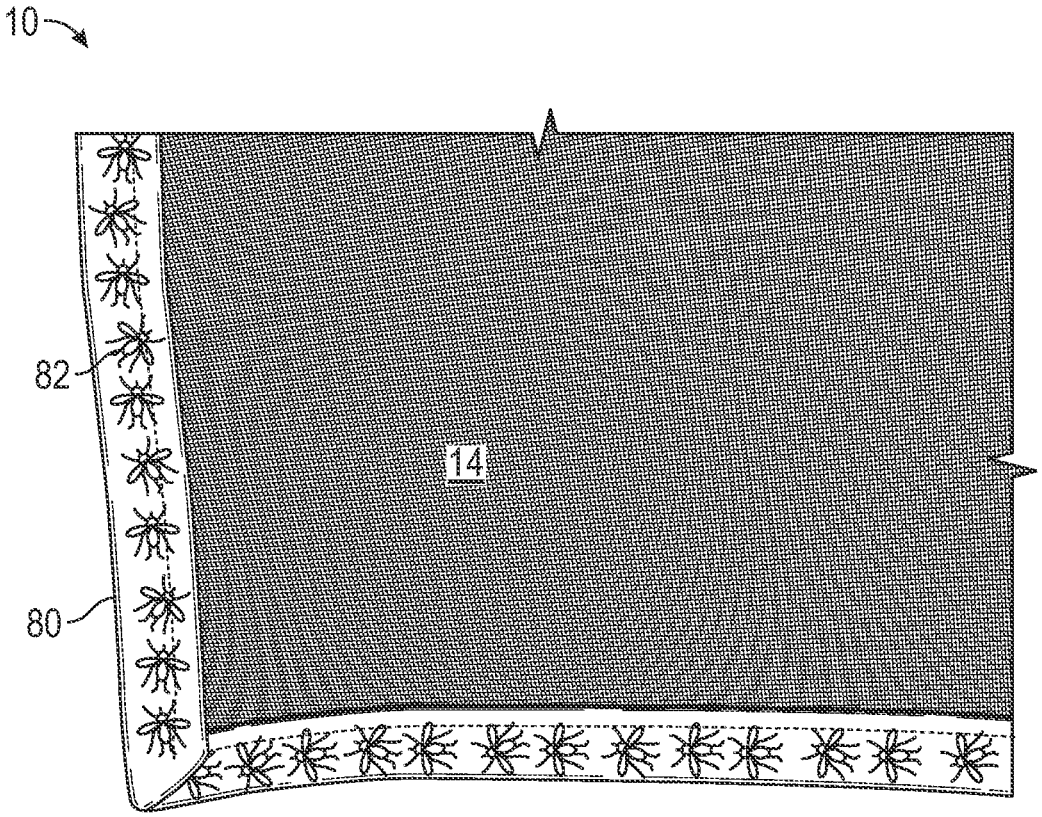
FIG. 4 is an enlarged perspective view of a portion of a trim of the cover of FIG. 1.

The protective cover 10 may further include a trim 80 surrounding all or at least a part of the outer periphery of the mesh sheet 14. As best shown in FIG. 4, the trim 80 may include an indicia 82. The indicia 82 may be a company name, logo, or any other design. The trim 80, in one embodiment, may be constructed or formed by a shape sustaining material such as those disclosed herein for the mesh sheet 14. Further, the trim 80 may be formed as a laminate of materials including one or more with a shape sustaining material. The trim 80 may be, but is not limited to being, formed with bias tape. The trim 80 may be formed of a variety of suitable outdoor materials known in the art including, but not limited to, canvas and canvas duck fabric. The trim 80 may also include one or more weighted magnets disposed along the outer periphery, or within the body of the mesh sheet 14, or in another embodiment, on one or more corners of the protective cover 10 for securing around a wearer or for securing the protective cover 10 in a substantially folded, straight, or other configuration. The mesh sheet 14 or the trim 80 may also include one or more fasteners for attaching the protective cover 10 to a structure such as, but not limited to, a doorway, window, tent, or hammock.

As shown in FIGS. 5 and 6, the protective cover 10 may be formed in a variety of desirable and wearable shapes to shield and protect the wearer 12 from undesirable insects while enjoying the outdoors. In addition to protecting the arms, legs, and torso of the wearer 12, the protective cover 10 may also be worn over the wearer's head. The protective cover 10 is easy to place and form on any area of the body or on an object. The protective cover 10 may form a bubble or microclimate around the wearer 12 so that the mesh sheet 14 does not substantially rest against the skin of the wearer 12—allowing unrestricted air flow through the protective cover 10 for enhanced breathability and comfort. The wearer 12 is also free to wear fashionable or message-containing clothing, the visual perception of which is unaltered by the protective cover 10. The protective cover 10 may eliminate the need for using harmful chemicals often found in traditional bug sprays or impregnated into protective garments.

Figure 7:
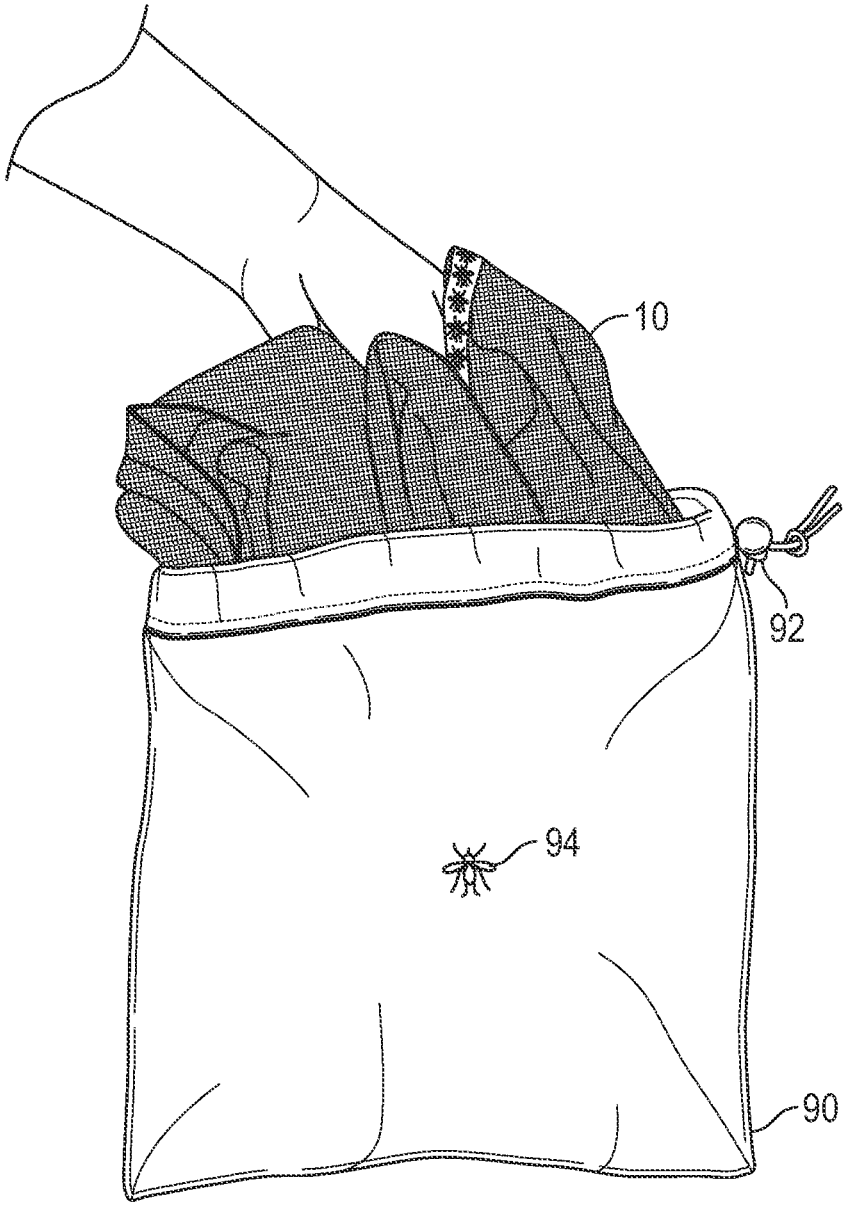
FIG. 7 is a front elevation view of the protective cover of FIG. 1 shown folded and being placed in a storage device, for example, a bag.

As shown in FIG. 7, the protective cover 10 may be easily folded and placed in a storage device, such as a bag 90 for storing and/or carrying the protective cover 10 to a desired location such as a ball game, a camping site, a beach, or the like. The bag 90 may be formed of a water-resistant material and may include a drawstring 92 for securing the protective cover 10 inside the bag 90. The bag 90 may also include an indicia 94 for a company name, logo, or other design. Because the protective cover 10 can be easily folded and may be formed of a machine-washable material, the protective cover 10 may be easily placed in a washing machine after use and before the next use. The storage device, such as the bag 90, may also be formed of the same material as the mesh sheet 14.

From the above description, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and claimed herein.

What is claimed is:

1. A cover for protecting against insects, comprising:

a mesh sheet having a first end, a second end, a top end, and a bottom end; and a pliable support member extending between the first end and the second end of the mesh sheet and spaced a first distance away from the top end of the mesh sheet, the pliable support member being movable between a straight configuration and a bent configuration, wherein the mesh sheet forms and sustains a wearable shape when the support member is in the bent configuration.

2. The cover of claim 1, wherein the mesh sheet is formed of a knit material of 100% polyester weighing about 0.8 ounces per square yard, with a denier count of about 300, and with a mesh count of about 400 allowing air passage but substantially preventing insect passage therethrough.

3. The cover of claim 2, wherein the mesh sheet is formed of a white, sheer knit material.

4. The cover of claim 1, wherein the pliable support member is formed of solid copper having a size of about 18 AWG.

5. The cover of claim 1, wherein the mesh sheet includes a sleeve for slidably receiving the pliable support member.

6. The cover of claim 5, wherein the sleeve includes an open end and a closed end.

7. The cover of claim 1, wherein the pliable support member includes a distal end, a proximal end, and a cap disposed on the proximal end.

8. The cover of claim 1, wherein the pliable support member is a first pliable support member, and the cover further comprises:

a second pliable support member extending between the first end and the second end of the mesh sheet and spaced a second distance away from the top end of the mesh sheet and spaced a distance away from the first pliable support member, the second pliable support member being movable between a straight configuration and a bent configuration, wherein the mesh sheet forms and sustains a wearable shape when each of the first pliable support member and the second pliable support member is in the bent configuration.

9. The cover of claim 8, wherein the mesh sheet is formed of a knit material of 100% polyester weighing about 0.8 ounces per square yard, with a denier count of about 300, and with a mesh count of about 400 allowing air passage but substantially preventing insect passage therethrough.

10. The cover of claim 9, wherein the mesh sheet is formed of a white, sheer knit material.

11. The cover of claim 8, wherein each of the first pliable support member and the second pliable support member is formed of solid copper having a size of about 18 AWG.

12. The cover of claim 8, wherein the mesh sheet includes a first sleeve for slidably receiving the first pliable support member and a second sleeve for slidably receiving the second pliable support member.

13. The cover of claim 12, wherein the first sleeve includes a first open end and a first closed end, and wherein the second sleeve includes a second open end, and a second closed end.

14. The cover of claim 8, wherein the first pliable support member includes a distal end, a proximal end, and a first cap disposed on the proximal end of the first pliable support member, and the second pliable support member includes a distal end, a proximal end, and a second cap disposed on the proximal end of the second pliable support member.

* * * * *